US008013799B2

(12) United States Patent
Chung et al.

(10) Patent No.: US 8,013,799 B2
(45) Date of Patent: Sep. 6, 2011

(54) DUAL-BAND MONOPOLE ANTENNA WITH ANTENNA SIGNAL FED THROUGH SHORT-CIRCUIT TERMINAL OF TRANSMISSION LINE

(75) Inventors: Shyh-Jong Chung, Hsinchu (TW); Yu-Hsin Wang, Taichung (TW); Yu-Chiang Cheng, Taipei (TW)

(73) Assignee: Getac Technology Corporation, Hsinchu (TW)

( * ) Notice: Subject to any disclaimer, the term of this patent is extended or adjusted under 35 U.S.C. 154(b) by 664 days.

(21) Appl. No.: 12/213,606

(22) Filed: Jun. 23, 2008

(65) Prior Publication Data

US 2009/0115677 A1 May 7, 2009

(30) Foreign Application Priority Data

Nov. 5, 2007 (TW) ..... 96141725 A
Mar. 4, 2008 (TW) ..... 97107521 A

(51) Int. Cl.
*H01Q 9/04* (2006.01)

(52) U.S. Cl. ..... 343/791; 343/895

(58) Field of Classification Search ..... 343/790, 343/791, 895

See application file for complete search history.

(56) References Cited

U.S. PATENT DOCUMENTS 5,617,105 A * 4/1997 Tsunekawa et al. ..... 343/702
6,177,911 B1 * 1/2001 Yuda et al. ..... 343/792
6,842,155 B1 * 1/2005 Yeh ..... 343/790

FOREIGN PATENT DOCUMENTS

EP 1198027 A1 4/2002
WO WO 97/12417 4/1997
WO WO 98/15031 4/1998

* cited by examiner

*Primary Examiner* — Tan Ho

(57) ABSTRACT

Disclosed is a dual-band monopole antenna with antenna signal fed through a short-circuit terminal of a transmission line load. The dual-band monopole antenna includes an antenna extension section and a transmission line load. The antenna extension section has a top terminal and a transmission line connection terminal. The transmission line connection terminal is connected to the transmission line load. The transmission line load includes a core transmission line, an outer circumferential conductor, and a dielectric layer. The core transmission line has an extension section connection terminal and a signal feeding terminal. The extension section connection terminal is connected to the transmission line connection terminal of the antenna extension section. The outer circumferential conductor circumferentially surrounds and is spaced from the core transmission line by a given distance and the outer circumferential conductor has an open terminal and a short-circuit terminal.

16 Claims, 14 Drawing Sheets

DUAL-BAND MONOPOLE ANTENNA WITH ANTENNA SIGNAL FED THROUGH SHORT-CIRCUIT TERMINAL OF TRANSMISSION LINE

FIELD OF THE INVENTION

The present invention relates to the field of monopole antenna, and in particular to a dual-band monopole antenna with antenna signal fed through a short-circuit terminal of a transmission line.

BACKGROUND OF THE INVENTION

Due to the trend of being compact and light-weighted for communication devices, such as electronic devices including personal digital assistants (PDAs), mobile phones, and notebook computers, and also due to the increasing need for wireless networking, miniaturization of antenna is now an important challenge for wireless communication products.

The currently available antenna can be classified as dipole antenna, monopole antenna, planar antenna, loop antenna, and disk antenna. Currently, various techniques have been developed for all these kinds of antenna.

For patent documents that are currently known, Taiwan Patent Publication No. M285057 discloses a dual-band monopole antenna, wherein the dual-band monopole antenna comprises a substrate, a first antenna, a second antenna, an impedance path section, and a grounding section.

On a surface of the substrate, two independent antennas, the first and second antennas, which are operated in different frequencies, are formed and the grounding section is provided at the terminals of the first and second antennas at the same side. The grounding section is arranged at a given distance from the terminals of the antennas at the same side and the grounding section is extended to form at least one impedance path section between the first and second antennas.

The impedance path section opposes the first and second antennas and is substantially parallel thereto in a horizontal direction. The impedance path section provides isolation between the radiated signals of the first and second antennas when the first and second antennas are respectively transmitting different signals in limited space on the substrate.

SUMMARY OF THE INVENTION

However, for the known dual-band monopole antennas of any design, to realize resonance in two bands, a first antenna and a second antenna are both needed. The known dual-band monopole antenna requires a two-antenna configuration that includes the first antenna and the second antenna and further, the known antenna has a bulky size, which is against the current trends of wireless communication products.

Thus, an objective of the present invention is to provide a transmission line loaded monopole antenna, wherein resonance in two bands, which is conventionally realized by two monopole antennas, is made possible with a single monopole antenna, while the elongate and slender configuration of a single monopole antenna is maintained to facilitate assembling of the antenna.

Another objective of the present invention is to provide a dual-band monopole antenna that is easy to make with a simplified manufacturing process.

The technical solution adopted in the present invention to overcome the above discussed drawbacks includes a transmission line load that is connected in serial to a monopole antenna and has a length smaller than a quarter wavelength in a designated operation frequency band to serve as an inductive load for reducing the frequency of high frequency resonance so as to realize operations in dual bands with a single monopole antenna.

In the relative positions of a transmission line load and a monopole antenna in accordance with the present invention, an antenna extension section has an end forming a top terminal and an opposite end forming a transmission line connection terminal and connected to the transmission line load that serves as the load.

In a preferred embodiment of the present invention, the transmission line load comprises a core transmission line, an outer circumferential conductor, and a dielectric layer. The core transmission line has an extension section connection terminal and a short-circuit terminal. The extension section connection terminal is connected to the transmission line connection terminal of the antenna extension section.

The outer circumferential conductor comprises a circumferentially-extending outer conductor ring that circumferentially surrounds and is spaced from the core transmission line by a given distance, and can be constituted by a screen shield or sheath of a coaxial cable. The outer circumferential conductor has an open terminal and a short-circuit terminal and cooperates with the core transmission line to interpose the dielectric layer therebetween.

With the solution provided by the present invention, the monopole that is externally added with a transmission line load features incorporation of an inductive load provided by the transmission line structure of the transmission line load and thus realizes control over high-order resonant frequency. Therefore, the present invention provides a monopole antenna that includes a transmission line load serving as an inductive load, whereby resonance in dual bands that is realized conventionally by two monopole antennas of different line lengths is made possible with a single monopole.

Further, adding a transmission line load, which serves as a transmission line structure, to a monopole antenna makes it possible to simplify the manufacturing process by using a currently available coaxial cable. Thus, the dual-band monopole antenna with antenna signal fed through a short-circuit terminal of a transmission line in accordance with the present invention can be of the advantages of easy manufacturing and maintaining the slender configuration in practical applications. Further, a single bending can be adopted to shorten the appearance length of the monopole antenna of the present invention, enhancing the applicability of the monopole antenna of the present invention in modern compact and light-weighted portable electronic devices.

BRIEF DESCRIPTION OF THE DRAWINGS

The present invention will be apparent to those skilled in the art by reading the following description of preferred embodiments thereof with reference to the drawings, in which.

DETAILED DESCRIPTION OF THE PREFERRED EMBODIMENTS

Figure 1:
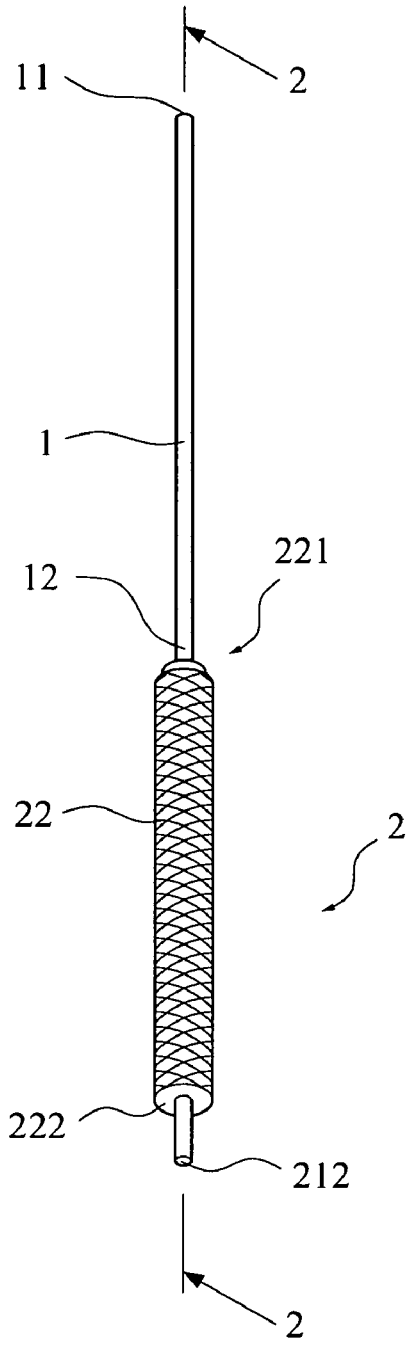
FIG. 1 is a perspective view of a dual-band monopole antenna with antenna signal fed through a short-circuit terminal of a transmission line constructed in accordance with a first embodiment of the present invention.
Figure 2:
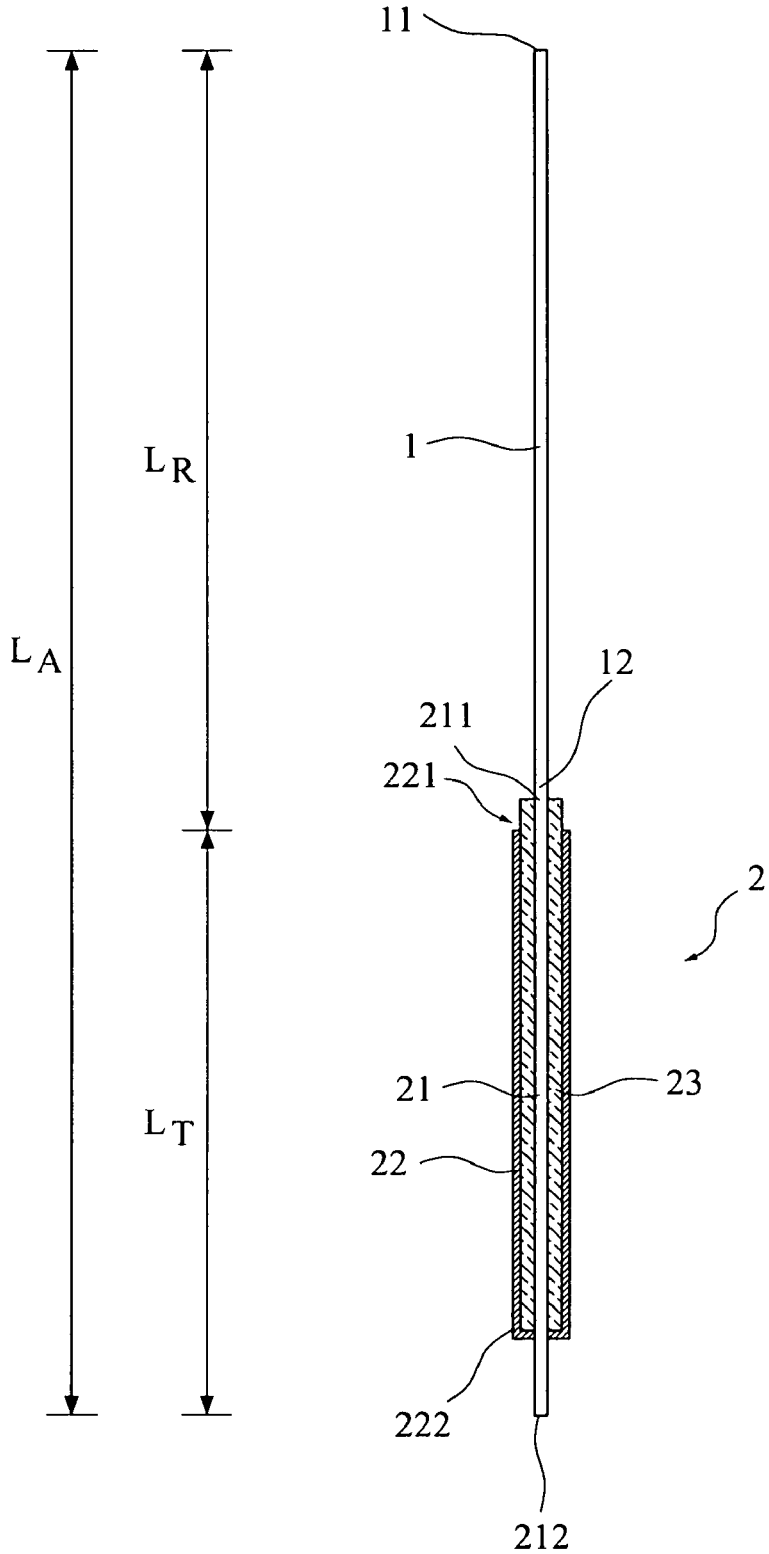
FIG. 2 is a cross-sectional view taken along line 2-2 of FIG. 1.

With reference to the drawings and in particular to FIG. 1, which shows a perspective view of a dual-band monopole antenna with antenna signal fed through a short-circuit terminal of a transmission line constructed in accordance with a first embodiment of the present invention, and FIG. 2, which is a cross-sectional view taken along line 2-2 of FIG. 1, an antenna extension section 1 has an end forming a top terminal 11 and an opposite end forming a transmission line connection terminal 12 and coupled to a transmission line load 2. The length of the antenna extension section 1 is set as "antenna extension section length $L_R$"; the length of the transmission line load 2 is set as "short-circuit transmission line length $L_T$"; and the overall length $L_A$ of the dual-band monopole antenna of the present invention is thus the sum of the antenna extension section length $L_R$ plus the short-circuit transmission line length $L_T$.

The transmission line load 2 comprises a core transmission line 21, an outer circumferential conductor 22, and a dielectric layer 23. The core transmission line 21 has an extension section connection terminal 211 and a signal feeding terminal 212. The extension section connection terminal 211 is connected to the transmission line connection terminal 12 of the antenna extension section 1. The outer circumferential conductor 22 comprises a circumferentially-extending outer conductor ring that is arranged to circumferentially surround and space from the core transmission line 21 by a given distance, and can be constituted by a screen shield or sheath of a coaxial cable. The outer circumferential conductor 22 has an open terminal 221 and a short-circuit terminal 222. A signal is fed from the signal feeding terminal 212 of the core transmission line 21, and then through the short-circuit terminal 222 of the outer circumferential conductor 22 to the transmission line load 2. The open terminal 221 of the outer circumferential conductor 22 is adjacent to the extension section connection terminal 211 of the core transmission line 2. The distance between the signal feeding terminal 212 of the core transmission line 21 and the open terminal 221 of the outer circumferential conductor 22 is the short-circuit transmission line length $L_T$.

The dielectric layer 23 is interposed between the core transmission line 21 and the outer circumferential conductor 22. The dielectric layer 23 can be for example air dielectric or made up of an insulation material, such as foamed polyethylene.

In the present invention, a capacitive or inductive load is added to the antenna to effect control of a second resonant frequency (high frequency) and the present invention is made to achieve the effect by providing a monopole antenna that is loaded by a transmission line structure that serves as a transmission line load 2. The transmission line load 2 itself can serve as a short-circuited transmission line. When the length of the transmission line load length $L_T$ is substantially equal to a quarter wavelength of the frequency of the second resonance, it can serve as an inductive load connected in serial to the antenna extension section 1.

For a monopole antenna, the inductive load can affect the frequency of the second resonance. Thus, the frequency of the second resonance can be controlled by properly adjusting the transmission line load length $L_T$ to eventually provide the monopole antenna of the present invention with the operability in dual bands. In the dual-band monopole antenna in accordance with the present invention, the distance between the signal feeding terminal 212 of the core transmission line 21 and the open terminal 221 of the outer circumferential conductor 22 is designed to be equivalent one-quarter wavelength of the second resonant frequency (high frequency), and the overall length of the monopole antenna 1 and the transmission line load 2 is selected to be substantially equal to equivalent one-quarter wavelength of a predetermined first resonant frequency (low frequency).

Figure 3:
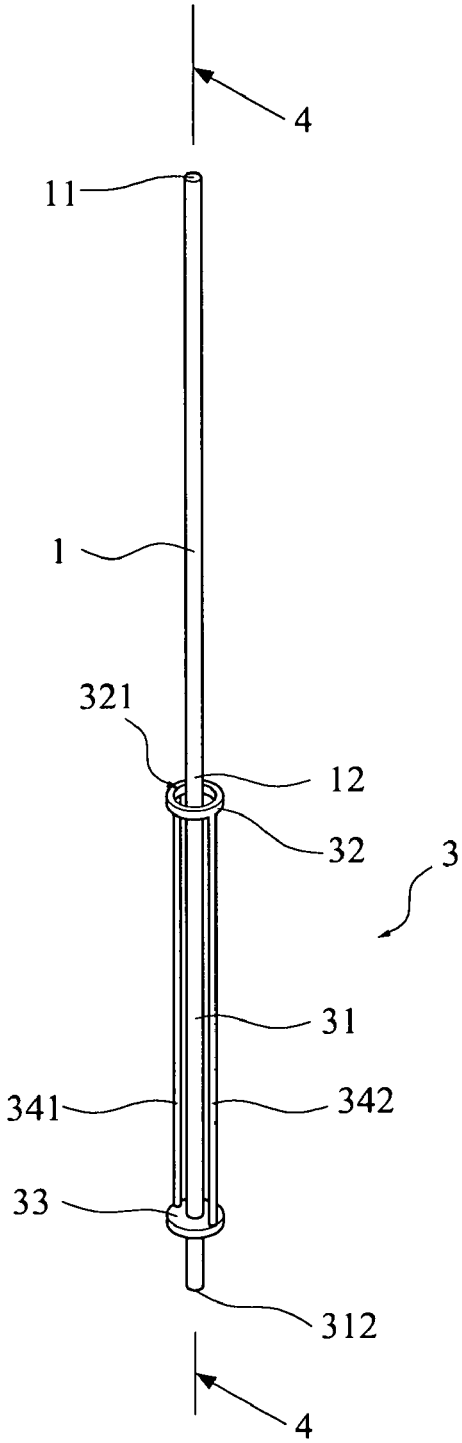
FIG. 3 is a perspective view of a dual-band monopole antenna with antenna signal fed through a short-circuit terminal of a transmission line constructed in accordance with a second embodiment of the present invention.
Figure 4:
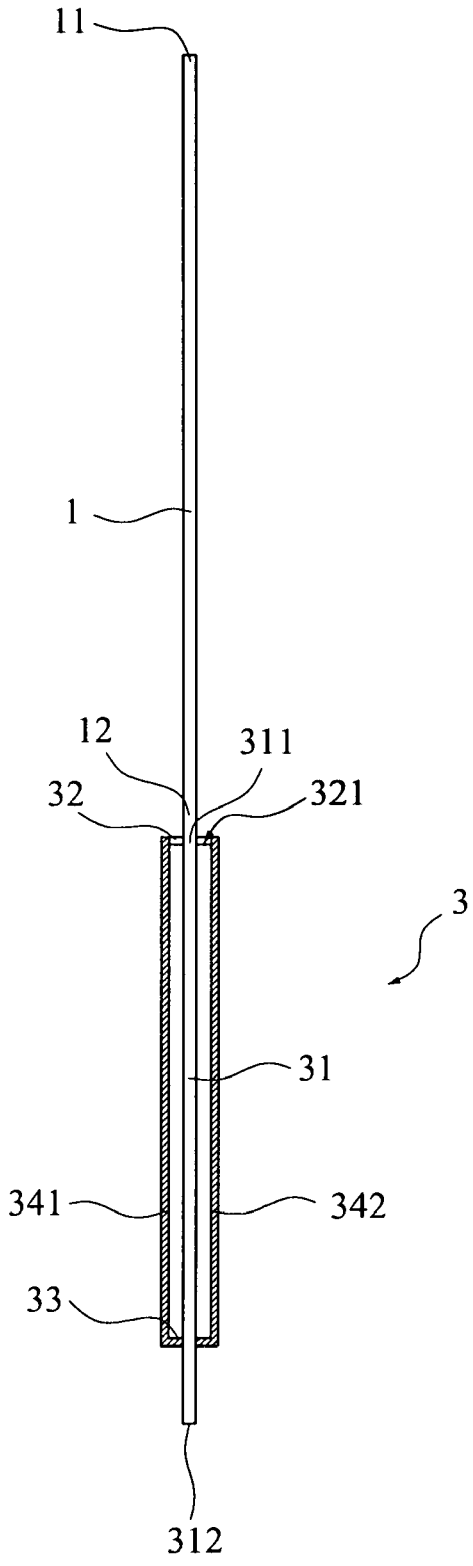
FIG. 4 is a cross-sectional view taken along line 4-4 of FIG. 4.

FIG. 3 shows a perspective view of a dual-band monopole antenna with signal fed through a short-circuit terminal of a transmission line constructed in accordance with a second embodiment of the present invention, and FIG. 4 shows a cross-sectional view taken along line 4-4 of FIG. 3.

An end of an antenna extension section 1 forms a top terminal 11 and an opposite end forms a transmission line connection terminal 12 and is connected to a transmission line load 3. The transmission line load 3 comprises a core transmission line 31, a carrier ring 32, a support ring 33, and a pair of parallel and spaced conductors 341, 342. The core transmission line 31 has an extension section connection terminal 311 and a signal feeding terminal 312. The extension section connection terminal 311 is connected to a transmission line connection terminal 12 of the antenna extension section 1.

The carrier ring 32 is arranged at the extension section connection terminal 311 of the core transmission line 31 and has an open terminal 321. The support ring 322 is arranged adjacent to the signal feeding terminal 312 of the core transmission line 31. The carrier ring 32 and the support ring 33 are respectively arranged at upper and lower ends of the core transmission line 31 and are spaced from the core transmission line 31 by a given distance. The carrier ring 32 and the support ring 33 are connected to each other by the pair of parallel conductors 341, 342. The two conductors 341, 342 are isolated from and spaced from the core transmission line 31 by a given distance by means of for example air dielectric or a non-conductive, insulation dielectric material, such as foamed polyethylene.

The outer circumferential conductor 22 of the transmission line load 2 in the embodiment shown in FIG. 2 is now replaced by two opposite conductors 341, 342 of the embodiment of FIG. 3.

Figure 5:
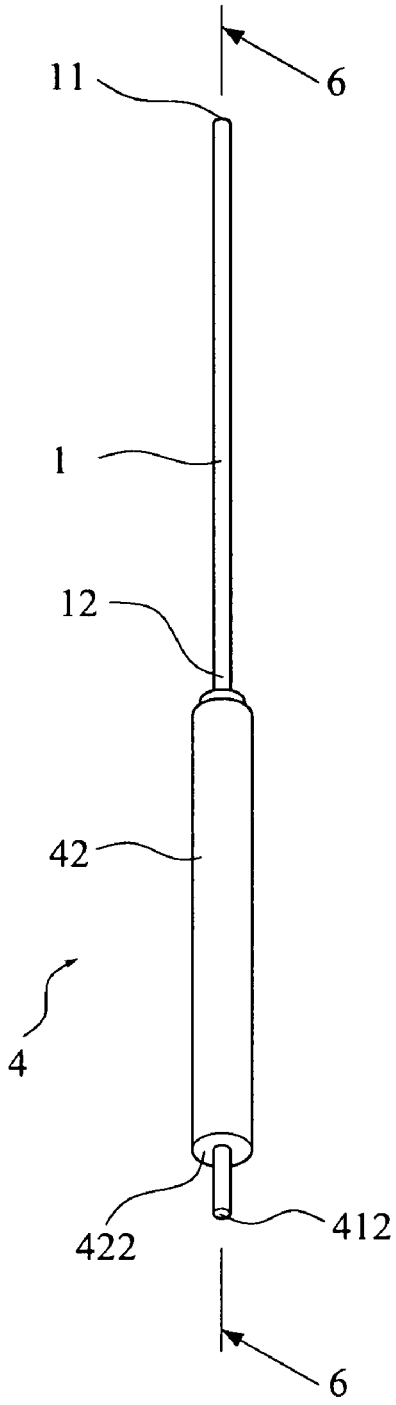
FIG. 5 is a perspective view of a dual-band monopole antenna with antenna signal fed through a short-circuit terminal of a transmission line constructed in accordance with a third embodiment of the present invention
Figure 6:
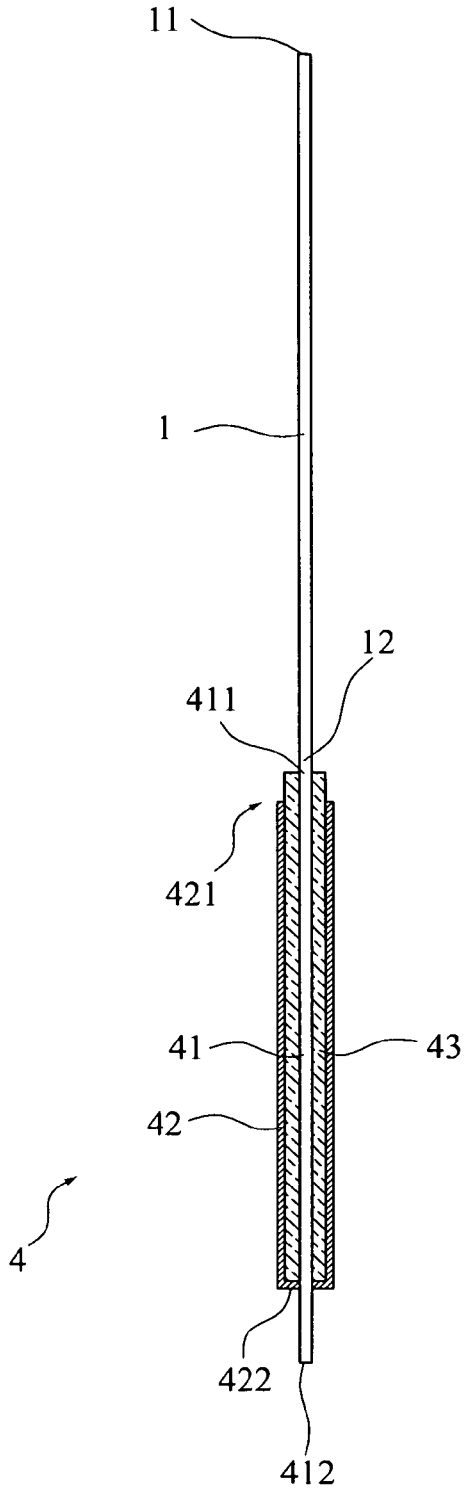
FIG. 6 is a cross-sectional view taken along line 6-6 of FIG. 5.

FIG. 5 shows a perspective view of a dual-band monopole antenna constructed in accordance with a third embodiment of the present invention, which is also shown in FIG. 6, which is a cross-sectional view taken along line 6-6 of FIG. 5.

An antenna extension section 1 has an end that forms a top terminal 11 and an opposite end forming a transmission line connection terminal 12 and connected to a transmission line load 4. The transmission line load 4 comprises a core transmission line 41, an outer circumferential conductor 42, and a dielectric layer 43. The core transmission line 41 has an extension section connection terminal 411 that is connected to the tranmission line connection terminal 12 and a signal feeding terminal 412.

The outer circumferential conductor 42 comprises a circumferentially-extending outer conductor ring that circumferentially surrounds and is spaced from the core transmission line 41 by a given distance, and is formed by a flexible metal tube. The outer circumferential conductor 42 has an open terminal 421 and a short-circuit terminal 422. The open terminal 421 of the outer circumferential conductor 42 is adjacent to the antenna extension section 1 so that the outer circumferential conductor forms an open structure facing the antenna extension section 1.

The dielectric layer 43 is interposed between the core transmission line 41 and the outer circumferential conductor 42. The dielectric layer 43 can be for example air dielectric or made up of an insulation material, such as foamed polyethylene.

Figure 7:
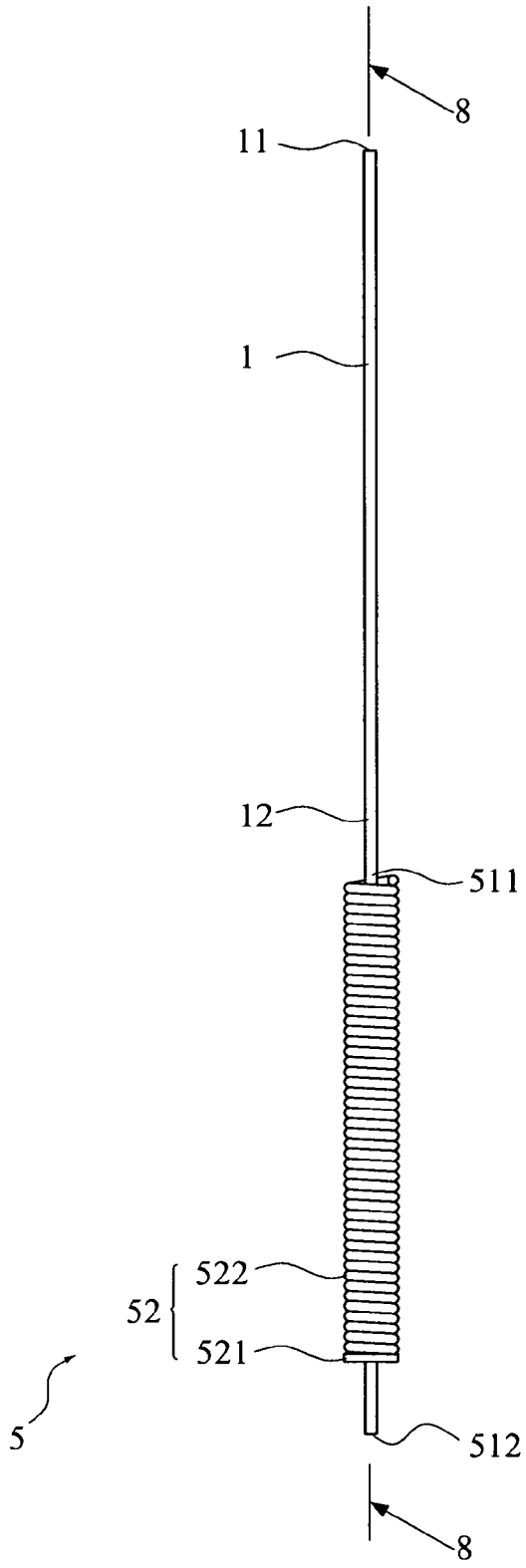
FIG. 7 is a perspective view of a dual-band monopole antenna with antenna signal fed through a short-circuit terminal of a transmission line constructed in accordance with a fourth embodiment of the present invention.
Figure 8:
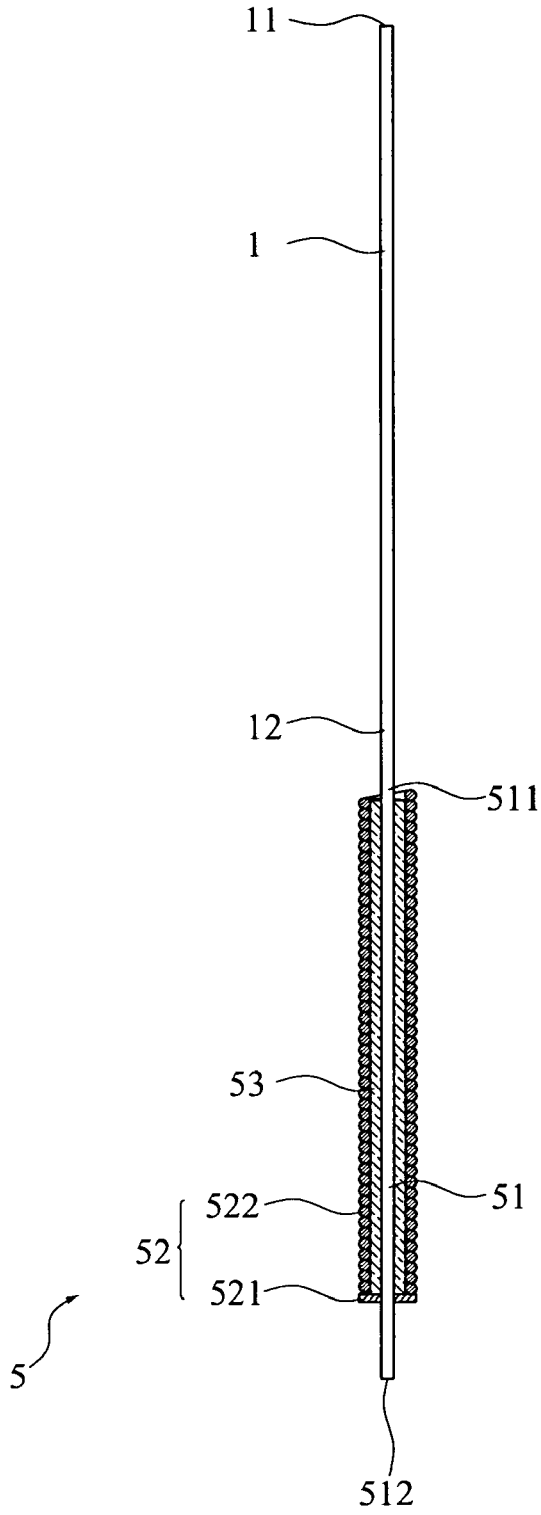
FIG. 8 is a cross-sectional view taken along line 8-8 of FIG. 7.

FIG. 7 shows a perspective view of a dual-band monopole antenna constructed in accordance with a fourth embodiment of the present invention, which is also shown in FIG. 8, which is a cross-sectional view taken along line 8-8 of FIG. 7.

A monopole antenna 1 has an end that forms a top terminal 11, and an opposite end forming a transmission line connection terminal 12 and connected to a transmission line load 5. The transmission line load 5 comprises a core transmission line 51, an outer circumferential conductor 52, and a dielectric layer 53. The core transmission line 51 has an extension section connection terminal 511 that is connected to the transmission line connection terminal 12 and a signal feeding terminal 512.

The outer circumferential conductor 52 comprises a circumferentially-extending outer conductor ring that circumferentially surrounds and is spaced from the core transmission line 51 by a given distance, and is formed by a support ring 521 and a spiral tube body 522 that is comprised of a plurality of tightly-engaging turns with zero spacing therebetween. The spiral tube body 522 has an end connected to the closed support ring 521 and forms an open structure adjacent to the transmission line connection terminal 12 of the monopole antenna 1.

The dielectric layer 53 is interposed between the core transmission line 51 and the outer circumferential conductor 52. The dielectric layer 53 can be for example air dielectric or made up of an insulation material, such as foamed polyethylene.

Figure 9:
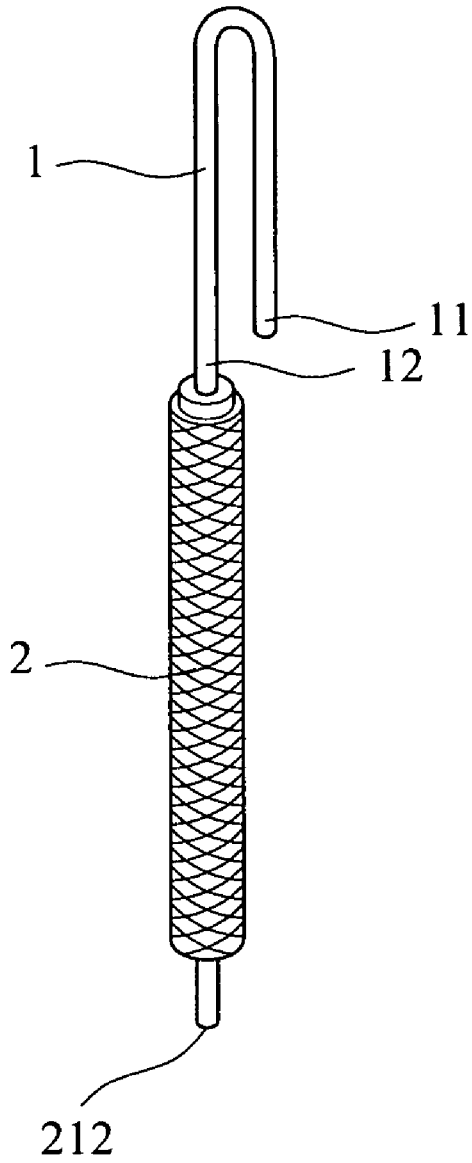
FIG. 9 shows a dual-band monopole antenna with antenna signal fed through a short-circuit terminal of a transmission line constructed in accordance with a fifth embodiment of the present invention.

FIG. 9 shows a dual-band monopole antenna with signal fed through a short-circuit terminal of a transmission line constructed in accordance with a fifth embodiment of the present invention. An antenna extension section 1 has an end forming a top terminal 11 and an opposite end forming a transmission line connection terminal 12 and connected to a transmission line load 2. The transmission line load 2 has a signal feeding terminal 212 to which an antenna signal can be fed. The antenna extension section 1 is folded to shorten an appearance length of the dual-band monopole antenna without affecting the length of the transmission path of the antenna extension section 1.

Figure 10:
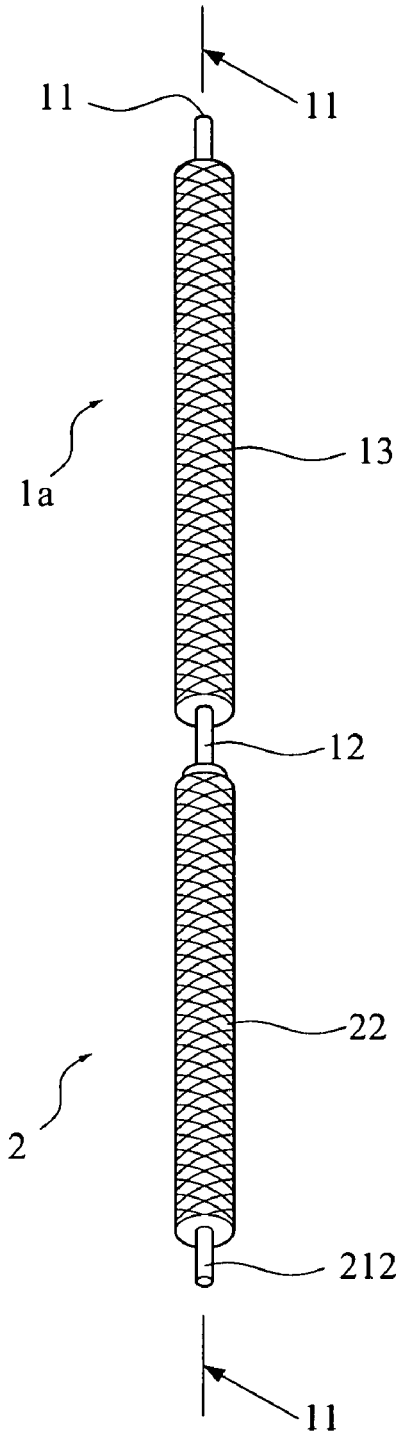
FIG. 10 shows a dual-band monopole antenna constructed in accordance with a sixth embodiment of the present invention.
Figure 11:
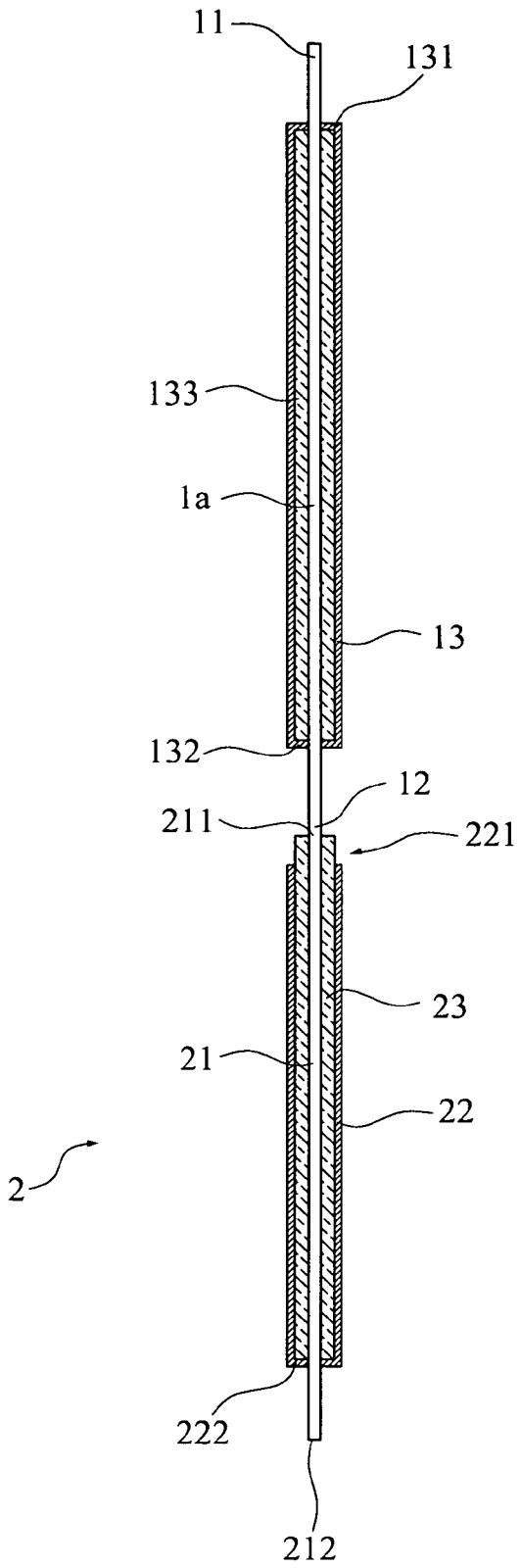
FIG. 11 is a cross-sectional view taken along line 11-11 of FIG. 10.
Figure 12:
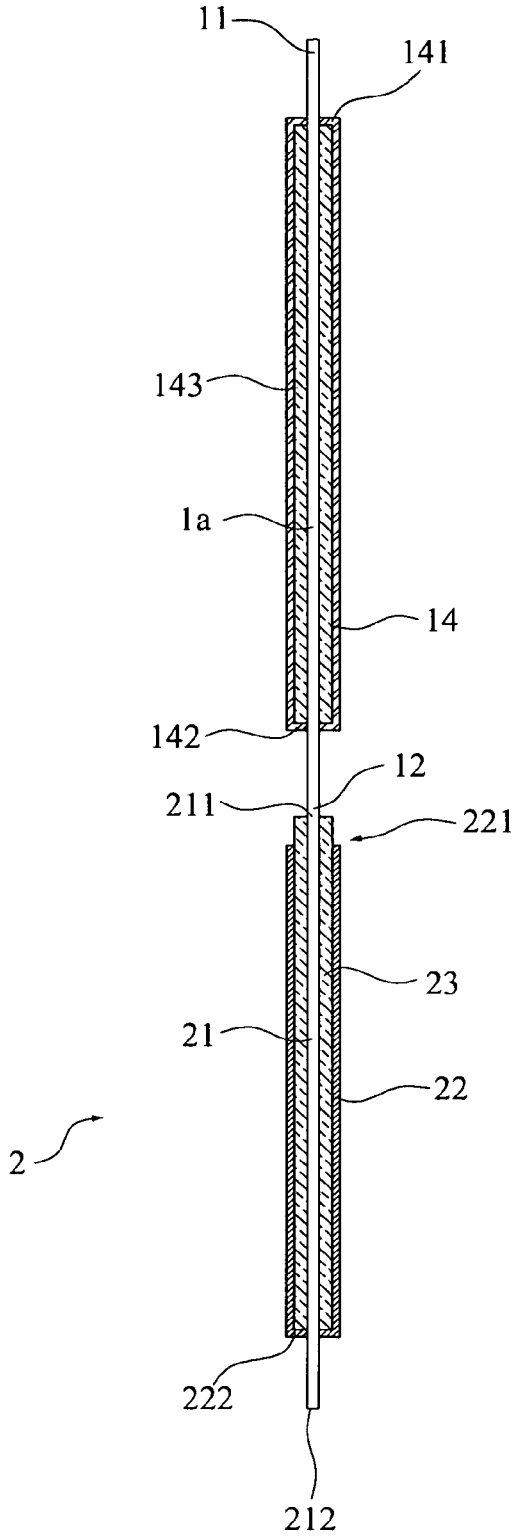
FIG. 12 is a cross-sectional view showing that an outer circumference tubular body is alternatively used as an outer conductor.
Figure 13:
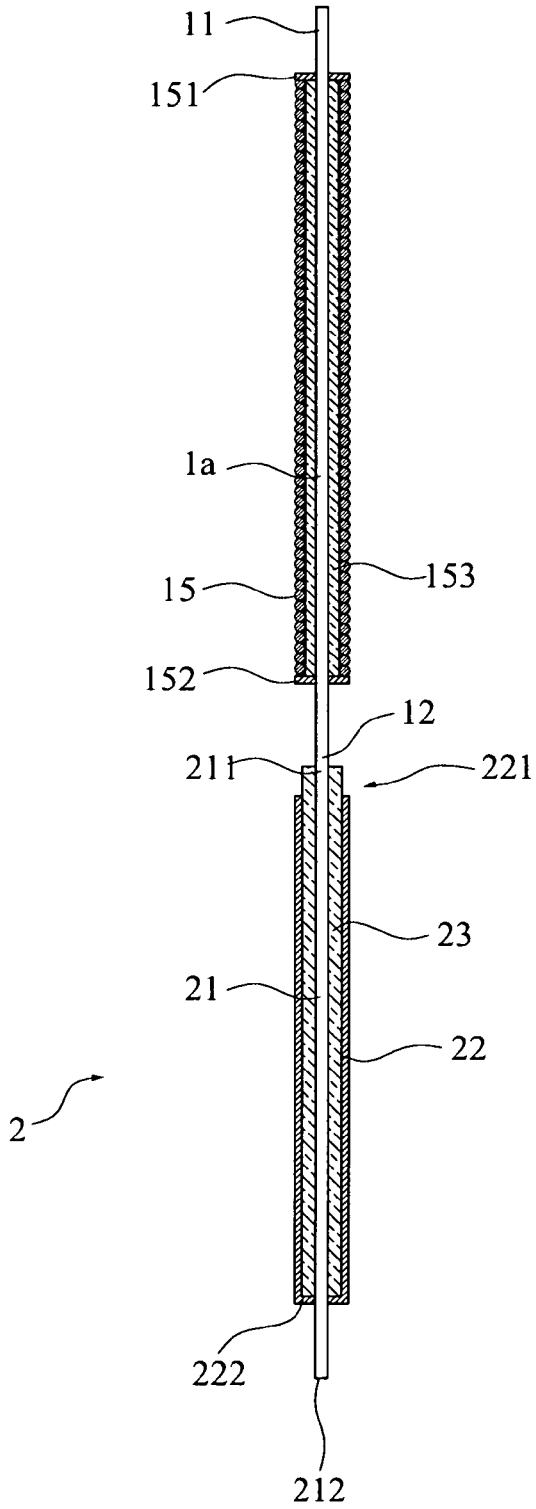
FIG. 13 is a cross-sectional view showing that an outer spiral body is alternatively used as an outer conductor.

FIG. 10 shows a dual-band monopole antenna constructed in accordance with a sixth embodiment of the present invention and FIGS. 11, 12 and 13 show variation embodiments of an outer conductor of the antenna of FIG. 10.

With simultaneous reference to FIGS. 10 and 11, the transmission line load 2 comprises a core transmission line 21 having an antenna connection terminal 211 that is connected to a transmission line connection terminal 12 of an antenna extension section 1*a* and a signal feeding terminal 212.

The core transmission line 21 is circumferentially surrounded by an outer circumferential conductor 22 that has an open terminal 221 forming an open structure with the opening facing the antenna extension section 1*a* and an opposite end that is closed and forms a short-circuit terminal 222. Further, a dielectric layer 23 is interposed between the core transmission line 21 and the outer circumferential conductor 22.

As shown in FIG. 11, the antenna extension section 1*a* is further surrounded by an outer conductor 13 in the form of a coaxial cable. The outer conductor 14 has opposite ends that are both closed terminals 131, 132, this being different from the outer circumferential conductor 22 that has an open structure including an open terminal 221. A dielectric layer 133 is interposed between an antenna extension section 1*a* and the outer conductor 13. The antenna extension section 1*a* is provided, by the added outer conductor 13, with a section having a relatively large diameter to realize a great bandwidth.

As shown in FIG. 12, the antenna extension section 1*a* is alternatively surrounded by an outer circumference tubular body 14, which is flexible and has opposite ends that are closed terminals 141, 142. A dielectric layer 143 is interposed between the antenna extension section 1*a* and the outer circumference tubular body 14. The antenna extension section 1*a* is provided, by the outer circumference tubular body 14 added thereto, with a section of relatively large diameter to realize a great bandwidth.

As shown in 13, the antenna extension section 1*a* is alternatively surrounded by an outer spiral body 15 having opposite ends that are closed by support rings 151, 152. A dielectric layer 153 is interposed between the antenna extension section 1*a* and the outer spiral body 15. The antenna section 1*a* is provided, by the outer spiral body 15 added thereto, with a section having a relatively large diameter to realize a great bandwidth.

Figure 14:
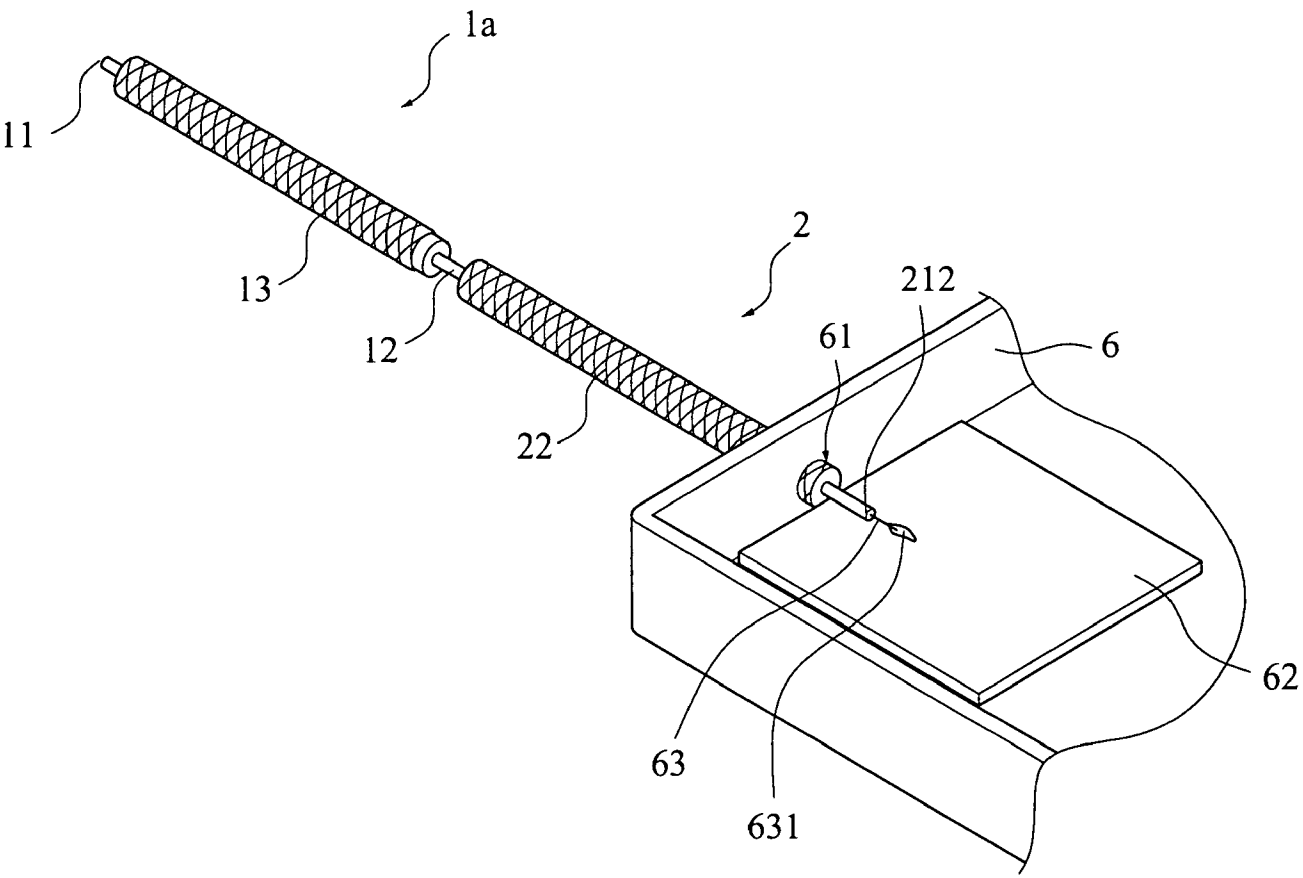
FIG. 14 a perspective view of a dual-band monopole antenna with antenna signal fed through a short-circuit terminal of a transmission line constructed in accordance with a seventh embodiment of the present invention.

FIG. 14 shows a perspective view of a dual-band monopole antenna with antenna signal fed through a short-circuit terminal of a transmission line constructed in accordance with a seventh embodiment of the present invention. An enclosure 6 of an electronic device has a surface forming in a suitable location a transmission line mounting hole 61. The signal feeding terminal 212 of the transmission line load 2 is mounted to the surface of the enclosure 6 through the transmission line mounting hole 61 defined in the surface of the enclosure 6.

The signal feeding terminal 212 extends through the transmission line mounting hole 61 defined in the enclosure 6 to be connected to a circuit board 62 that mates the dual-band monopole antenna. The circuit board 62 is arranged at an end of the enclosure 6. A signal end 631 is connected to the signal feeding terminal 212 of the transmission line load 2 through a feeding signal transmission path 63. The enclosure 6 serves as the grounding point of the dual-band monopole antenna.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A dual-band monopole antenna, comprising:

a transmission line load comprising:

a core transmission line having an extension section connection terminal and a signal feeding terminal, and an outer circumferential conductor circumferentially surrounding and spaced from the core transmission line by a given distance, the outer circumferential conductor having an open terminal and a short-circuit terminal, an antenna signal being fed from the signal feeding terminal of the core transmission line to the transmission line load through the short-circuit terminal of the outer circumferential conductor; and an antenna extension section having a top terminal and a transmission line connection terminal, the transmission line connection terminal being connected to the extension section connection terminal of the core transmission line, wherein a distance from the signal feeding terminal of the core transmission line to the open terminal of the outer circumferential conductor defines a short-circuit transmission line length, the short-circuit transmission line length being set to correspond to an equivalent quarter wavelength of a predetermined second resonant frequency, an overall length of the dual-band monopole antenna being defined by a sum of a length of the antenna extension section and the short-circuit transmission line length and being set corresponding to an equivalent quarter wavelength of a predetermined first resonant frequency.

2. The dual-band monopole antenna as claimed in claim 1 further comprising a dielectric layer interposed between the core transmission line and the outer circumferential conductor.

3. The dual-band monopole antenna as claimed in claim 2, wherein the dielectric layer comprises dielectric selected from a group consisting of air and an insulation material of foamed polyethylene.

4. The dual-band monopole antenna as claimed in claim 1, wherein the transmission line load comprises a transmission line formed by a length of coaxial cable and wherein the outer circumferential conductor is formed by a screen shield of the coaxial cable.

5. The dual-band monopole antenna as claimed in claim 1, wherein the outer circumferential conductor comprises at least two parallel and spaced conductors.

6. The dual-band monopole antenna as claimed in claim 1, wherein the outer circumferential conductor comprises an outer spiral tube body.

7. The dual-band monopole antenna as claimed in claim 1, wherein the outer circumferential conductor comprises a flexible metal tube.

8. The dual-band monopole antenna as claimed in claim 1, wherein the transmission line load comprises an inductive load connected in serial with the monopole antenna.

9. The dual-band monopole antenna as claimed in claim 1 further comprising an outer conductor having a relatively large diameter arranged on the antenna extension section.

10. The dual-band monopole antenna as claimed in claim 1 further comprising an outer circumference tubular body having a relatively large diameter arranged on the antenna extension section.

11. The dual-band monopole antenna as claimed in claim 1 further comprising an outer spiral body having a relatively large diameter arranged on the antenna extension section.

12. The dual-band monopole antenna as claimed in claim 1, wherein the signal feeding terminal of the core transmission line is connected to a mating circuit board via a feeding signal transmission path, and is mounted at an enclosure.

13. The dual-band monopole antenna as claimed in claim 12, wherein the feeding signal transmission path has an end forming a signal end connected to the core transmission line and the enclosure serving as a grounding point for the antenna.

14. The dual-band monopole antenna as claimed in claim 1, wherein the transmission line load is folded sideways to shorten length of the transmission line load.

15. A dual-band monopole antenna, comprising:

a transmission line load comprising:

a core transmission line having an extension section connection terminal and a signal feeding terminal, and an outer circumferential conductor circumferentially surrounding and spaced from the core transmission line by a given distance, the outer circumferential conductor having an open terminal and a short-circuit terminal, an antenna signal being fed from the signal feeding terminal of the core transmission line to the transmission line load through the short-circuit terminal of the outer circumferential conductor; and an antenna extension section having a top terminal and a transmission line connection terminal, the transmission line connection terminal being connected to the extension section connection terminal of the core transmission line, wherein the outer circumferential conductor comprises at least two parallel and spaced conductors.

16. A dual-band monopole antenna, comprising:

a transmission line load comprising:

a core transmission line having an extension section connection terminal and a signal feeding terminal, and an outer circumferential conductor circumferentially surrounding and spaced from the core transmission line by a given distance, the outer circumferential conductor having an open terminal and a short-circuit terminal, an antenna signal being fed from the signal feeding terminal of the core transmission line to the transmission line load through the short-circuit terminal of the outer circumferential conductor; and an antenna extension section having a top terminal and a transmission line connection terminal, the transmission line connection terminal being connected to the extension section connection terminal of the core transmission line, wherein the outer circumferential conductor comprises an outer spiral tube body.

* * * * *